US007096879B2

(12) United States Patent
Yardley

(10) Patent No.: US 7,096,879 B2
(45) Date of Patent: Aug. 29, 2006

(54) PILLAR SINK MIXER WITH HAND SPRAY

(75) Inventor: Duncan Yardley, Essex (GB)

(73) Assignee: Avilion Limited, (GB)

( * ) Notice: Subject to any disclaimer, the term of this patent is extended or adjusted under 35 U.S.C. 154(b) by 183 days.

(21) Appl. No.: 10/689,679

(22) Filed: Oct. 22, 2003

(65) Prior Publication Data

US 2004/0123910 A1 Jul. 1, 2004

(30) Foreign Application Priority Data

Oct. 22, 2002 (GB) ..... 0224580.1

(51) Int. Cl.
*E03C 1/04* (2006.01)

(52) U.S. Cl. ..... 137/119.03; 137/340; 137/597; 137/606

(58) Field of Classification Search ..... 137/597, 137/606, 340, 119.03, 119.05
See application file for complete search history.

(56) References Cited

U.S. PATENT DOCUMENTS 1,704,198 A * 3/1929 Judell ..... 137/597
1,790,625 A * 1/1931 Kent ..... 137/597
2,741,258 A * 4/1956 Bletcher et al. ..... 137/217
2,830,618 A * 4/1958 Mitchell ..... 137/599.03
4,609,006 A 9/1986 Parkison et al.
4,706,709 A 11/1987 Monch
5,025,825 A * 6/1991 Gayton ..... 137/119.04
5,257,824 A 11/1993 Eggen
5,778,921 A 7/1998 Ko
5,881,754 A 3/1999 Wei

FOREIGN PATENT DOCUMENTS

EP 71729 * 6/1982
GB 2 361 047 1/2001

OTHER PUBLICATIONS

Catalog from Danze, "Two Handle Kitchen Faucet With Exposed Bridge" (Mar. 2001).

* cited by examiner

*Primary Examiner*—Stephen M. Hepperle
(74) *Attorney, Agent, or Firm*—Dickstein Shapiro LLP

(57) ABSTRACT

A pillar sink mixer has a hot water faucet pillar, a cold water faucet pillar, a mixing chamber and a diverter valve to supply mixed water to a faucet nozzle or to a hand spray. The mixing chamber and diverter valve are positioned in a bridge above a mounting surface, and a passage, providing fluid communication with the hand spray device, being incorporated within the bridge and a faucet pillar.

4 Claims, 2 Drawing Sheets

PILLAR SINK MIXER WITH HAND SPRAY

This invention relates to pillar faucets (water taps) in which the faucet body is mounted some distance above a work top, and in particular to faucets having a mixing system to mix hot and cold water and a separate manually operated spray nozzle attached to the water mixer by a flexible tube. Such arrangements are often found in domestic kitchens.

GB2361047 discloses a pillar faucet system that provides a spray nozzle with a separate flexible hose. The water supply to the spray nozzle, and control of the temperature of the water so supplied, comes from the same mixer system as that used for the faucet nozzle via a diverter in the mixing chamber. Whilst this system does provide a spray nozzle, it has a number of disadvantages. One disadvantage is that the mixing chamber is under the mounting surface, occupying a large amount of space. The valves controlling the water flow are housed below the mounting surface and controlled by long spindles extending down from the faucet levers, through the pillars.

According to an aspect of the present invention there is provided a pillar sink mixer comprising a hot faucet pillar, a cold faucet pillar and a mixing chamber situated, in use, above a mounting surface for the mixer. The mixing chamber is in fluid communication with a hand spray via a channel that is partially situated within one of the faucet pillars.

Faucet housings at the top of the pillar stems house the valve chambers and connect via a bridge. A mixing chamber is positioned on the bridge and an outlet nozzle extends from the mixing chamber.

The water passage from one faucet housing to the mixing chamber runs alongside a return passage from the mixing chamber to the housing, Within the pillar supporting the faucet housing is a passage supplying water to the valve and another passage delivering the water from the return passage to the hose of a hand spray.

Other aspects and features of the invention will be apparent from the following description and the accompanying claims, The invention will now be described, by way of example only, with reference to the accompanying drawings in which:

Figure 1:
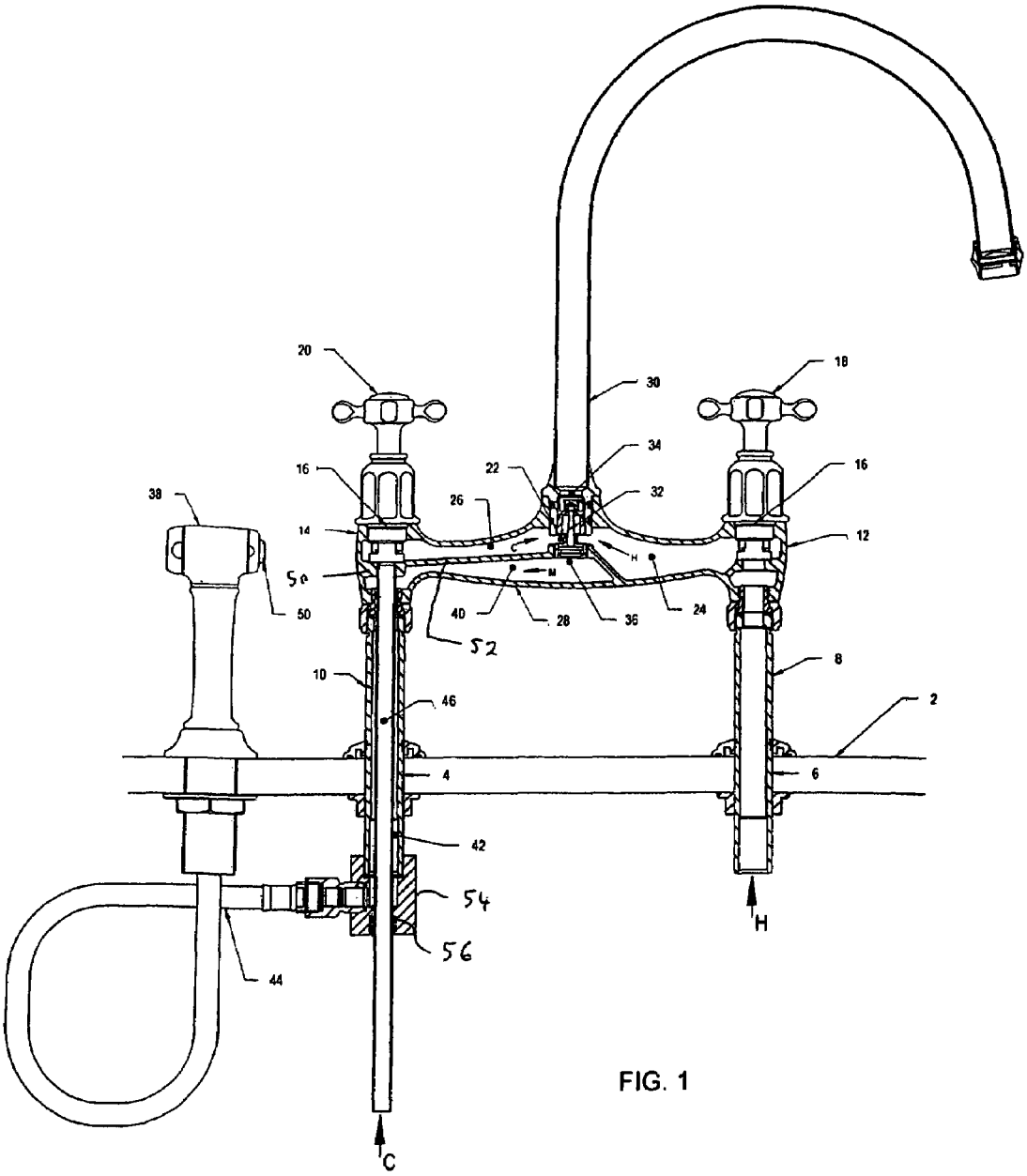
FIG. 1 shows a cross-sectional view of an embodiment of the present invention.

FIG. 1 shows a pillar mixer faucet forming an embodiment of the present invention. The mixer is mounted on a mounting surface 2, such as a kitchen top or sink rim, in which two holes 4, 6 are formed to receive the two faucet pillars 8, 10. Hot water enters the pillar sink mixer through the faucet pillar 8, and cold water enters the pillar sink mixer through pillar 10. Each pillar 8, 10 has a housing 12, 14 at its top end which houses a valve chamber and valve 16 operated by levers or handles 18, 20. The housings 12, 14 are both in fluid connection with a mixing chamber 22 via passages 24 and 26 respectively in a bridge 28. When the respective faucet valves 16 are opened, water flows into the mixing chamber 22 through the passages 24, 26, and through outlet nozzle 30 which is mounted on the bridge 28 at an outlet 34 of the mixing chamber 22. The arrangement thus far described is well known in the art of pillar sink mixers.

The mixing chamber 22 houses a diverter valve 32 which determines the direction of flow of the mixed water from the mixing chamber 22. The diverter valve 32 has two outlets

34, 36 which lead respectively to faucet nozzle 30 and a hand spray 38. The diverter valve 32 is an exclusive output system, therefore whilst the hand spray 38 is in operation, substantially no water will pass to the faucet nozzle 30. The operation of diverter valves is well known and is described for example in U.S. Pat. No. 4,609,006.

Figure 2:
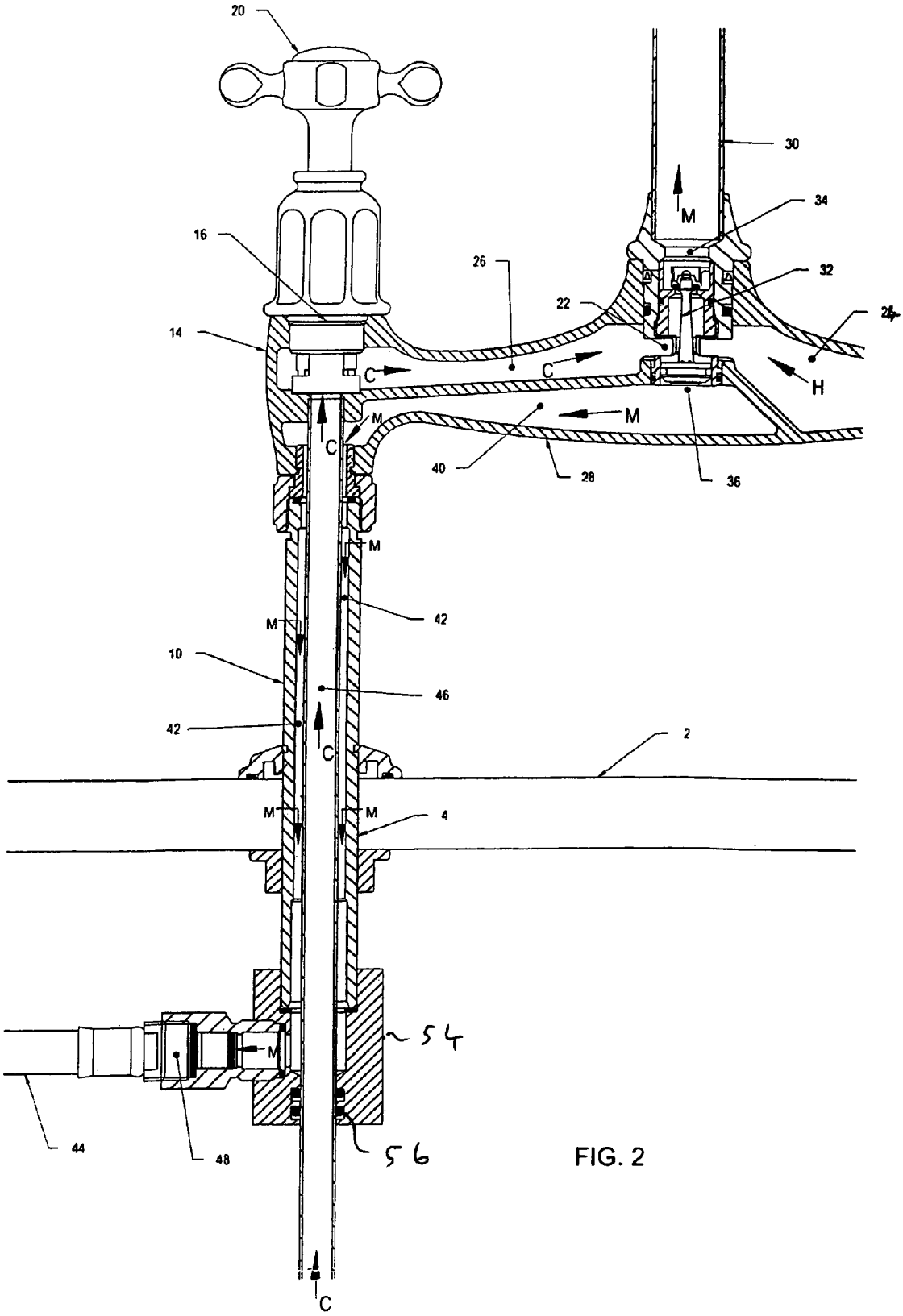
FIG. 2 shows an enlarged cross-sectional view of the cold faucet pillar of the embodiment of FIG. 1.

Referring to FIG. 2, the hand spray outlet channel which provides a fluid communication channel for the mixed water from the mixing chamber 22 to the hand spray 38, comprises three portions 40, 42, 44. The first portion comprises a passage 40 from the second outlet 36 of the mixing chamber 22 to the faucet housing 14. Passage 40 is housed within bridge 28, alongside passage 26. The second portion comprises passage 42 that is defined by the wall of faucet pillar 10. Within the pillar 10 is a tube 46 which delivers cold water up through the pillar 10 to valve 16. Tube 46 is sealed at its upper end to a valve seat 50 in partition wall 52. Tube 46 extends down within pillar 10. These two passages 42, 46 are thus housed within pillar 10. The third portion of the hand spray outlet channel is a flexible hose 44 that provides fluid communication from an outlet 48 from the lower end of the faucet pillar 10, beneath the mounting surface 2 to the hand spray 38. A T-shaped union is mounted on the lower end of pillar 10 and tube 46 passes through union 54, with a seal 56 being provided between the tube 46 and union 54 at the lower outlet of the union 54. Flexible hose 44 is coupled to the side outlet of the union 54, in fluid communication with passage 42. The hand spray 38 can be lifted out from the mounting surface 2.

The operation of the hand spray is well known. Valves 16 are opened by turning handles 18, 20 to give the required water flow through nozzle 30 via mixing chamber 22. Cold water passing through passage 46, via valve 16 to passage 26, chamber 22 and nozzle 30. When a push button valve on hand spray 38 is pressed, water can flow from spray 38. Diverter valve 22 is caused to move to close off the outlet 34 to nozzle 30, by the pressure differential across the valve ends, so that water will then flow out of mixing chamber outlet 36. Water flows through passages 40, 42 and hose 44 to spray 38.

It will be appreciated that the passage 40 may be directed towards hot faucet housing 12, pillar 8 enclosing the passage 46 and connecting with the hose 44.

The invention provides a pillar mixer with a hand spray function and yet with minimal additional space requirement.

The invention claimed is:

1. A pillar sink mixer having a hand spray, in which hot and cold valves are supported on respective pillars, the pillars being joined by a bridge having a mixing chamber and supporting a faucet nozzle, wherein a water passage from the mixing chamber to the spray extends through one of the pillars.

2. A pillar sink mixer comprising:

a hot faucet pillar and a cold faucet pillar in a spaced-apart relationship, each faucet pillar including a water valve housing, situated above a mounting surface;

a mixing chamber in a bridge situated above said mounting surface between said water valve housings, the mixing chamber having a first inlet in fluid communication with said water valve housing of said hot faucet pillar by a first conduit, a second inlet in fluid communication with said water valve housing of said cold faucet pillar by a second conduit, and two outlets, a first outlet in fluid communication with a faucet nozzle and a second outlet in fluid communication with a hand spray device;

wherein said hand spray device is in fluid communication with said outlet of said mixing chamber through a hand spray outlet passage, a portion of which is housed in at least one of said faucet pillars.

3. A pillar sink mixer as claimed in claim 2, wherein said mixing chamber includes a diverter valve, arranged to divert the flow of mixed water from said first outlet of said mixing chamber to said second outlet of said mixing chamber, said second outlet being in fluid communication with said hand spray device, when said hand spray device is operated to discharge water therefrom.

4. A pillar sink mixer comprising:

a hot faucet pillar and a cold faucet pillar joined by a bridge situated, in use, above a mounting surface, a diverter valve in the bridge and having outlets in fluid communication with a faucet nozzle mounted on the bridge and with a hand spray;

wherein a part of a passage providing fluid communication between the diverter valve and the hand spray is situated within one of said faucet pillars.

* * * * *